US005876616A

United States Patent [19]

Ugalde et al.

[11] Patent Number: 5,876,616

[45] Date of Patent: Mar. 2, 1999

[54] SLIDING SHUTDOWN DEVICE TO CONTROL THE FLOW OF MELTED METAL FROM A MELT RECIPIENT

[75] Inventors: Tomás Aurrekoetxea Ugalde, Bilbao; Gonzalo Guinea Ibarra, Getxo, both of Spain

[73] Assignee: Deguisa, S.A., Bilbao, Spain

[21] Appl. No.: 614,132

[22] Filed: Mar. 12, 1996

[30] Foreign Application Priority Data

Mar. 17, 1995 [ES] Spain ..... 9500552

[51] Int. Cl.[6] ..... B22D 41/28; B22D 41/40

[52] U.S. Cl. ..... 222/600; 222/606

[58] Field of Search ..... 164/337, 437, 164/488; 222/600, 606, 607; 266/236

[56] References Cited

U.S. PATENT DOCUMENTS

| | | | |
|---|---|---|---|
| 4,017,010 | 4/1977 | Meier | 222/600 X |
| 4,189,073 | 2/1980 | Lothmann | 222/600 |
| 4,424,958 | 1/1984 | Bachmann | 266/236 X |
| 4,582,232 | 4/1986 | Shapland et al. | 222/600 |
| 5,020,703 | 6/1991 | McQuillian, Jr. et al. | 222/600 X |
| 5,110,018 | 5/1992 | Lothmann et al. | 266/236 X |

FOREIGN PATENT DOCUMENTS

| | | | |
|---|---|---|---|
| 2255126 | 7/1975 | France . | |
| 2308448 | 11/1976 | France . | |
| 666334 | 7/1988 | Switzerland | 222/600 |
| 2125520 | 3/1984 | United Kingdom . | |
| WO94/03295 | 2/1994 | WIPO . | |

*Primary Examiner*—J. Reed Batten, Jr.
*Attorney, Agent, or Firm*—Vaden, Eickenroht & Thompson, L.L.P.

[57] ABSTRACT

The device is made up of two refractory plates, one of them fixed (15) and externally joined to the melt recipient and fitted with a hole matching the outlet nozzle of the recipient, and a sliding one (16) fitted with a refractory melted metal conveyance pipe, which sliding plate is fitted on a tilting frame (25) so that it is capable of sliding linearly. The sliding refractory plate (16) and the refractory pipe (5) are composed of two independent parts that are assembled upon a metal plate (11). The stationary (15) and sliding (16) refractory plates feature similar dimensions and structures and are fitted with a peripheral compression collar (2).

2 Claims, 4 Drawing Sheets

FIG. 1
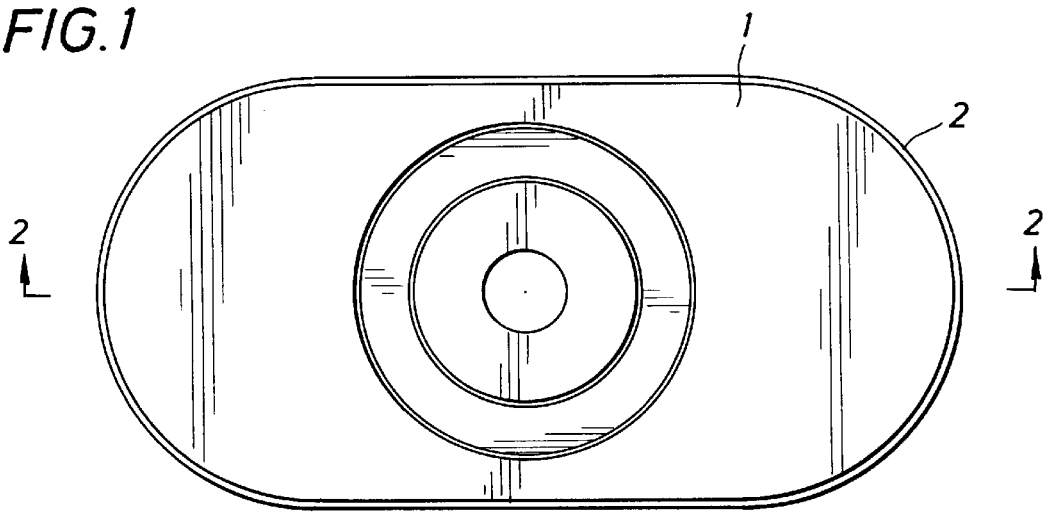
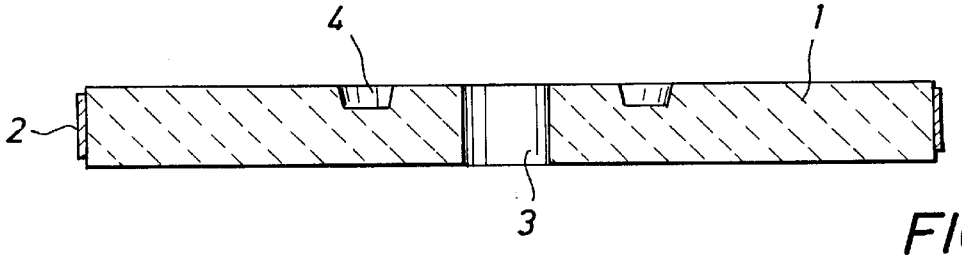
FIG. 2
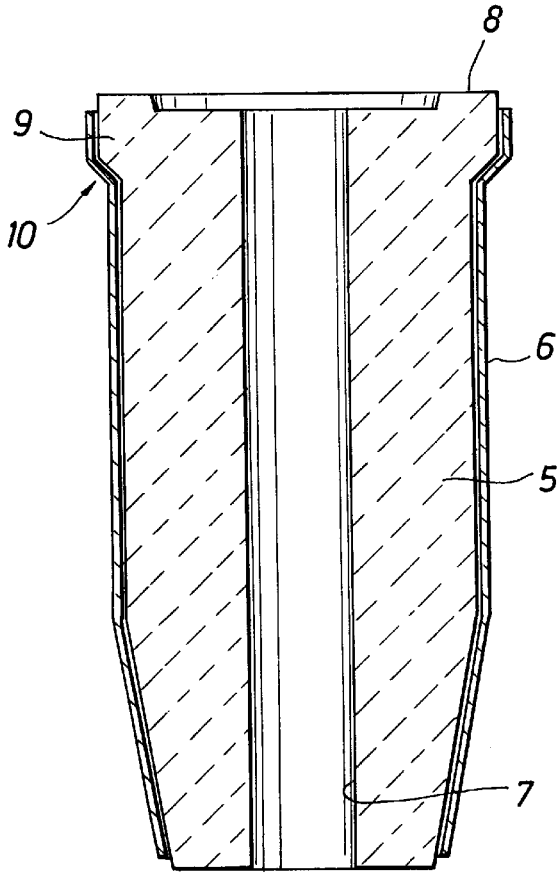
FIG. 3

FIG. 4
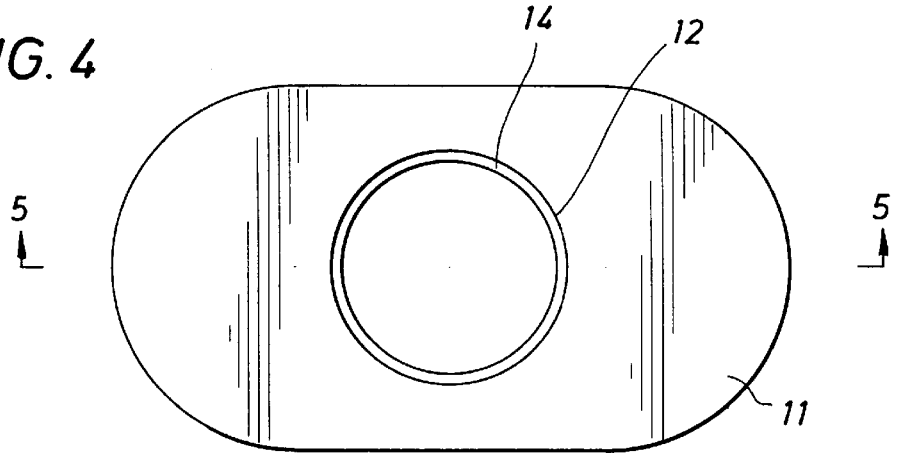
FIG. 5
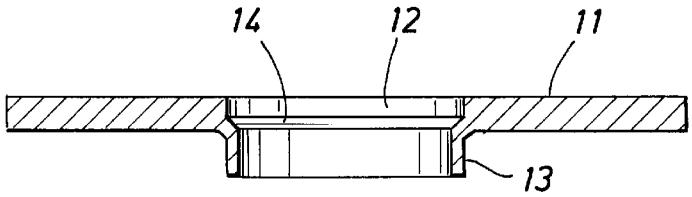
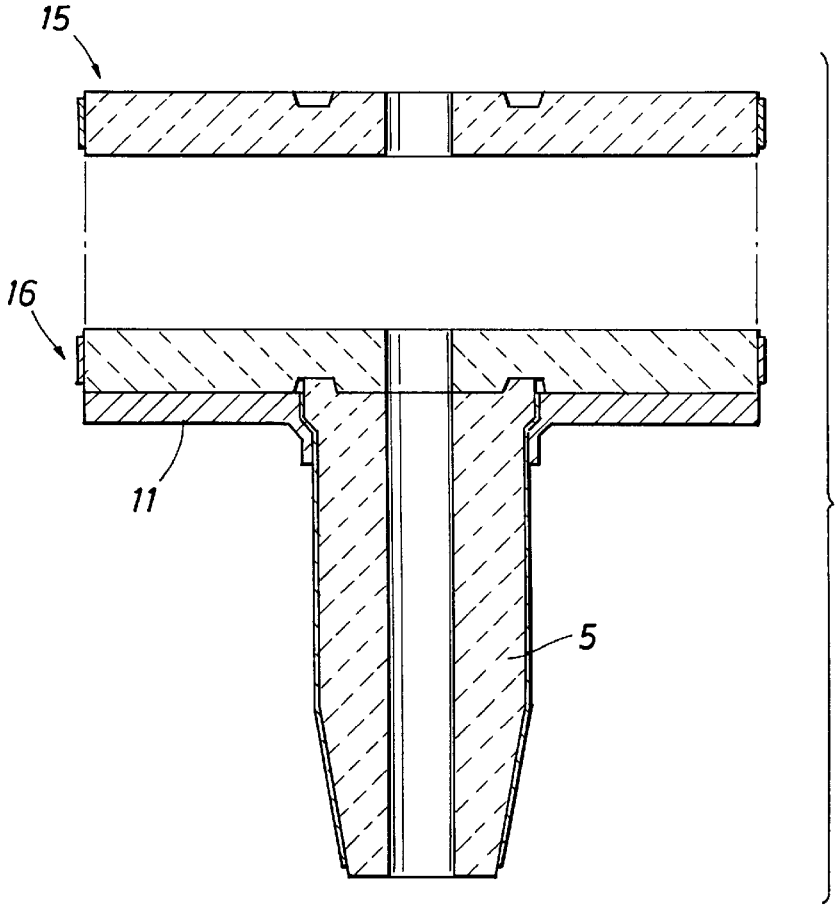
FIG. 6

SLIDING SHUTDOWN DEVICE TO CONTROL THE FLOW OF MELTED METAL FROM A MELT RECIPIENT

This invention refers to a sliding shutdown device used to control the flow of melted metal from a metal recipient, applicable to recipients used to cast steel, aluminum, brass, etc.

More specifically, the shutdown device object of this invention is of the type that incorporate a stationary refractory plate and a sliding refractory plate; which stationary refractory plate is attached externally to the metal recipient and has a hole that coincides with the outlet nozzle or muzzle of said recipient; and which sliding plate has a refractory pipe to convey the melted metal and is assembled in such a way that it is capable of sliding linearly on a tilting frame articulated to a fixed structure and including elastic pressure elements that act upon the sliding plate.

A shutdown device of the above type is described in Spanish patent number 403,522, which further foresees the inclusion of elastic elements to achieve the necessary degree of fastening pressure between the stationary and sliding plates. These elastic elements are assembled on the tilting frame that carries the sliding refractory plate, around the refractory pipe that conveys the melted metal, which requires a specific design, fitting the stationary and sliding refractory plates with external armoring based on a metal reinforcement plate. The refractory pipe that conveys the melted metal is furthermore attached to a sliding refractory plate, constituting a single part.

The existence of refractory plate reinforcement does not make it possible to achieve a preferentially uniform distribution of pressure between said plates.

On the other hand, and due to the fact that the refractory pipe that conveys the melted metal is attached to the sliding plate, every time that one of these components breaks down it is then necessary to substitute the whole assembly, which results in a higher repair cost.

Furthermore, and because of the different structure of the refractory plates, both stationary and sliding, they may not be interchanged.

The object of this invention is a sliding shutdown device of the previously described type, in which the stationary and sliding refractory plates would feature a higher level of performance, a better pressure distribution and uniform action between said plates would be achieved, and the various components can be individually substituted whenever the process made any such substitution necessary.

Pursuant to this invention, the refractory pipe that conveys the melted metal and the sliding refractory plate are formed by two independent parts that couple together. This special configuration makes it possible to inspect the pipe at any time and to substitute as needed, independently of the refractory plates, which makes the system much safer and less costly, due to the performance of the refractory pipe being totally independent from the performance of the sliding refractory plate.

Throughout the working life of the shutdown device the sliding refractory plate normally wears down earlier than the metal conveying refractory pipe. The previously described configuration enables the refractory plate to be substituted independently of the refractory pipe, thus allowing a longer use of the latter part.

According to another feature of the invention the traditional reinforcement of the sliding refractory plate is substituted by a peripheral collar and a metal plate to distribute the pressure. This plate is attached to the external surface of the sliding refractory plate and is made of steel, with a girth approximately equal to that of the refractory plate. The metal plate is furthermore fitted with a hole for the passage and retention of the refractory pipe.

The metal pressure distribution plate performs two essential functions: on the one hand it uniformly transmits the pressure of the elastic elements that are assembled on the sliding plate base structure, thus achieving a uniform action between the sliding and stationary plates. On the other hand it presses the refractory pipe that conveys the melted metal against the sliding refractory plate, holding it and enabling its sliding motion to coincide with the sliding motion of the mechanism carrier.

A higher level of performance between the refractory plates is then achieved because of the achievement of a more uniform pressure distribution through the modified arrangement of the previously mentioned metal plate.

Regarding the previously mentioned collar, it shall also be made of metal and be assembled after being heated up to enable its expansion and placement around the perimeter of the refractory plates, both stationary and sliding. When the collar cools down it then contracts, exercising uniform pressure around the perimeter of the refractory plates, thus achieving a better level of protection, enabling the plates to remain unaltered after suffering thermal shocks produced by the passage of melted metal through the passage hole of the refractory plates and which may cause them to crack. The attachment of this collar does not require the use of any type of refractory cement, which considerably reduces the plate manufacturing cost. Furthermore, this practice enables the inexistence of any foreign elements between the refractory plate and its holding element that may in any way have an influence upon the appearance of any damage of the plates because of different expansion and contraction rates during the melted metal casting process, as well as any possible malformation due to knocks and/or aging.

In short, the use of the configuration herein advanced enables elimination of the steel armored plates that in the traditional systems surround both the stationary plate and the sliding plate together with the metal conveying refractory pipe, being said armored plates substituted by the collar and the pressure distribution plate attached to the external surface of the sliding refractory plate.

The use of the configuration described enables the sliding and stationary refractory plates to be of the same size and configuration, allowing the substitution of a plate by another, as needed.

The features of the invention may be better understood by reading the description that follows, prepared with references to the attached drawings, which show a possible execution of the invention, supplied as a non limitative example.

In the drawings:

FIG. 1 is a plan view of a refractory plate, configured in accordance with the invention, for a sliding shutdown device.

FIG. 2 is a lengthwise section of the refractory plate, taken as per the II—II cut-off line of FIG. 1.

FIG. 3 is a diameter section of the refractory pipe that conveys the melted metal.

FIG. 4 is a plan view of the metal pressure distribution plate that includes the sliding shutdown device object of this invention.

FIG. 5 is a lengthwise section of the metal plate, taken as per the V—V cut-off line of FIG. 4.

FIG. 6 represents a lengthwise section of the assembly formed by the stationary and sliding refractory plates and the refractory melted metal conveyance pipe that includes the sliding shutdown device object of the invention.

Figure 7:
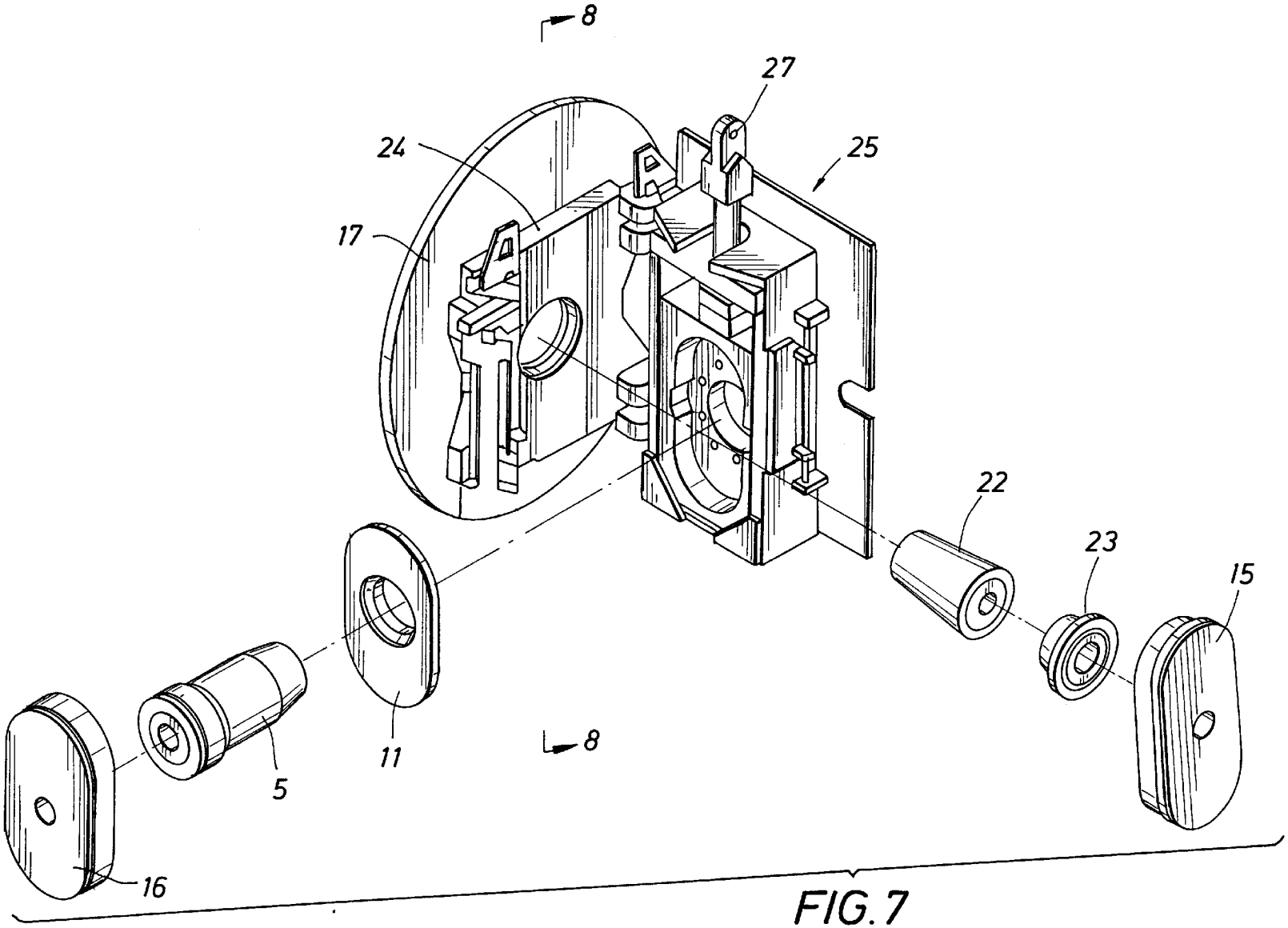
FIG. 7 is a perspective view of a sliding shutdown device configured pursuant to the invention, with the tilting frame that carries the sliding refractory plate in the open position.

FIGS. 1 and 2 feature a refractory plate 1 to which a peripheral metal collar 2 has been fitted. The assembly of this collar is effected by heating it up previously, in order to get it to expand, and placing it around refractory plate 1. When the collar cools down it does then contract, exercising a uniform pressure around all the periphery of the refractory plate 1. The refractory plate is further fitted with a central passage hole 3.

The above configuration is applicable both to the stationary refractory plate and to the sliding refractory plate of the shutdown device, having both plates a similar configuration, constitution and dimensions, factors that enable being interchanged, if required.

Whenever the plate shown in FIGS. 1 and 2 is used as a stationary plate, it is then placed in the position shown in FIG. 2, with the ring shaped canal 4 facing upwards for its coupling, as explained below with reference to FIG. 8. On the other hand, whenever the plate shown in FIGS. 1 and 2 is used as a sliding plate, it is then placed in the upside down position, so that the metal outlet refractory conduit, depicted in FIG. 3 with reference number 5, is coupled on to canal 4. This conduit may be fitted with an external sleeve 6, has an axial passage that opposes the hole 3 and its crowned at its upper end by a ring shaped projection 8 which is coupled onto the ring shaped canal 4.

According to another feature of the invention, the sliding shutdown device includes a pressure distribution metal plate 11, FIGS. 4 and 5 which shall be attached to the lower surface of the sliding refractory plate, as will be described further on. As may be observed in FIG. 3, the upper end of the refractory pipe 5 forms a widening 9 that determines an inverted peripheral step 10.

According to another feature of the invention, the sliding shutdown device includes a pressure distribution metal plate 11, FIGS. 4 and 5 which is to be attached upon the internal surface of the sliding refractory plate, having a girth approximately equal to that of the latter. This metal plate 11 has a central orifice 12 downwardly surrounded by a peripheral wall 13, which forms a ring shaped reduction step 14. The orifice 12, wall 13 and reduction step 14 are sized to receive the melted metal conveying refractory pipe 5 shown in FIG. 3, all of that as will be later explained by reference to FIG. 6, where are shown in their relative position the stationary 15 and sliding 16 refractory plates with their different components.

As may be observed in FIG. 6, the two refractory plates 15 and 16 have identical configuration and dimensions, occupying mutually inverted positions. The metal conveying pipe 5 is coupled to the lower surface of sliding plate 16, where it is then held in place by the metal plate 11.

Figure 8:
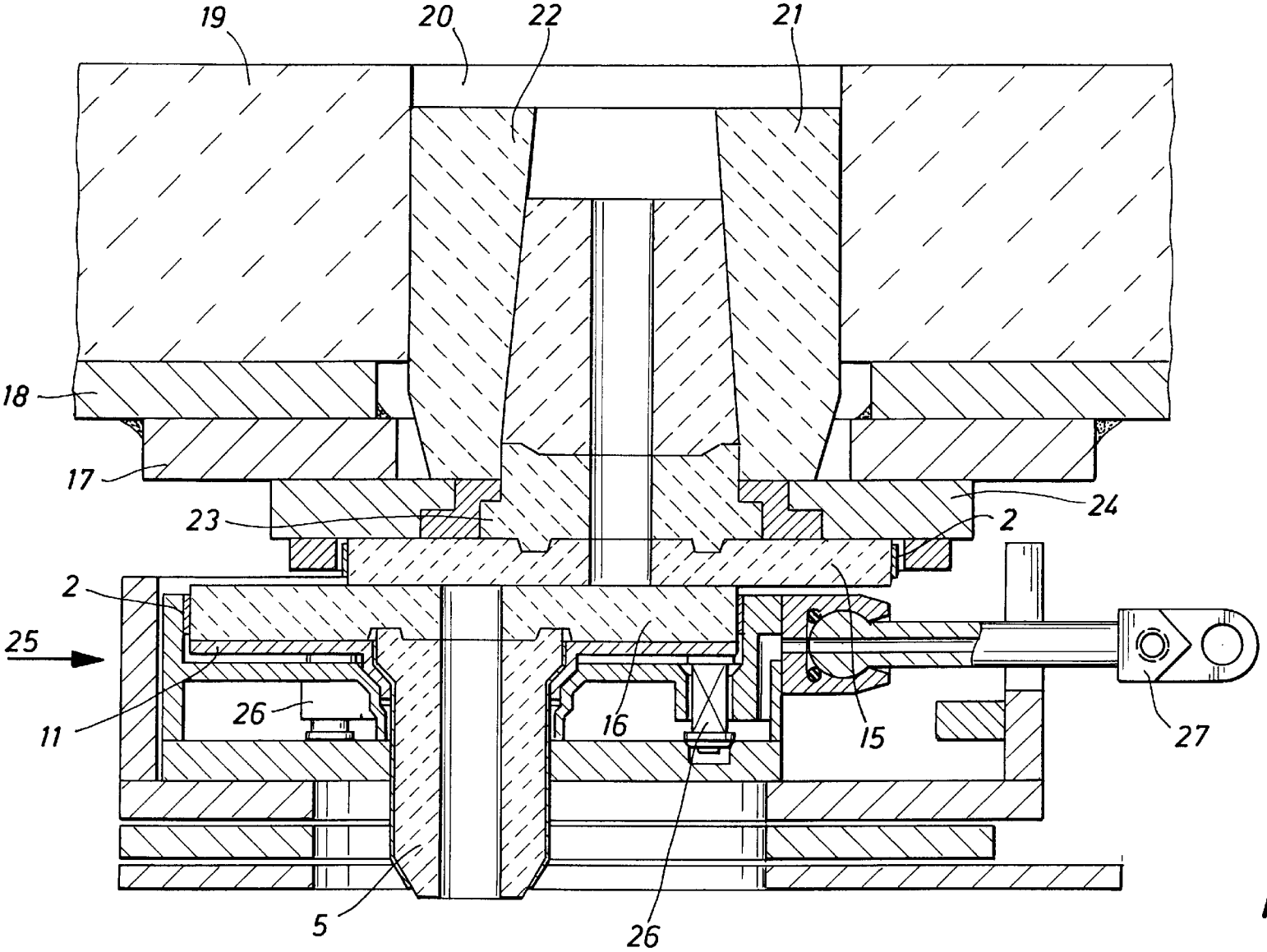
FIG. 8 represents a sliding shutdown device configured pursuant to the invention and applied to a casting recipient, cut as per the VIII—VIII cut-off line of FIG. 7.

FIGS. 7 and 8 represent a sliding shutdown device that incorporates the features object of this invention. This shutdown device incorporates a plate 17 that shall be attached externally to the bottom end 18 of the melt recipient, with the corresponding passage holes arranged opposite each other. The recipient 18 has an internal refractory material lining 19 with outlet opening 20 to which is coupled the tubular block 21 and the parts 22 and 23 that determine the outlet muzzle. A structure 24, to which a tilting frame 25 has been articulated, is externally attached to plate 17. The stationary refractory plate 15 is assembled upon the base structure 24, whereas the sliding refractory plate 16 and the metal outlet refractory pipe 5 are assembled on to the tilting frame 25.

Elastic elements 26 act upon the external surface of metal plate 11, as may be better observed in FIG. 8. The existence of metal plate 11 enables the action of the elastic elements 26 to be evenly spread against the refractory plate 16, so that it is then uniformly pressed against refractory plate 15.

At the same time metal plate 11, through the structure describe with reference to FIGS. 4 and 5, holds the refractory pipe 5 and presses it against the sliding refractory plate 16.

The opening of the shutdown device, as shown in FIG. 7, enables the simple and individual disassembly of refractory plates 15 and 16, as well as the refractory pipe 5, metal plate 11 and components 22 and 23 of the collar of the recipient.

Should the sliding plate 16 be damaged before pipe 5, these components could then be disassembled in order to replace only plate 16, and enabling the refractory pipe 5 to be retained for further use. Plates 15 and 16 may also be interchanged as required, given that they have the same configuration and dimensions.

FIGS. 7 and 8 depict, marked with reference number 27, the hydraulic cylinder connection arm which purpose is to cause the sliding motion of the sliding refractory plate 16.

In respect of any remaining characteristics, the shutdown device shown in FIGS. 7 and 8 is of the traditional type, as regards both its configuration and operation.

We claim:

1. Sliding shutdown device used to control the flow of melted metal from a melt recipient having an outlet nozzle or muzzle, including a stationary refractory plate (15) and a sliding refractory plate (16); which stationary plate (15) is externally attached to the melt recipient (18) and is fitted with a hole (3) matching the outlet nozzle or muzzle (22, 23) of said recipient (18); and which sliding plate (16) is fitted with a refractory melted metal conveying pipe (5) and is assembled so that it is capable of linear displacement upon a tilting frame (25) articulated to a fixed base structure (24) and including elastic pressure elements (26) that act upon the sliding plate (16), said sliding device comprising the sliding refractory plate (16) and the refractory melted metal conveying pipe (5) are formed by two independent parts capable of being coupled to each other, which are assembled upon a pressure distributing metal plate (11) with a girth approximately matching that of the refractory plate (16) and fitted with a hole (12) for the passage and retention of the refractory pipe (5); and the stationary (15) and sliding (16) refractory plates feature the same dimensions and structures and are fitted with a peripheral compression collar (2); and further comprising the refractory melted metal conveying pipe (5) is crowned close to the base adjacent to the refractory plate (16) with a peripheral widening (9), whereas the metal pressure distribution plate (11) has, around the hole (12) provided for the passage of said pipe (5), an external wall (13) that forms a narrowing shaped internal ring (14) sized so as to serve as a seating surface for the said peripheral widening (9) of the pipe (5) and press said pipe (5) against the refractory plate (16).

2. Shutdown device of claim 1, wherein the peripheral collar (2) used to compress the refractory plates (15, 16) is of a metallic nature and is pressure-assembled over said plates (15, 16) so that it exerts a constant pressure upon their edge or periphery.

* * * * *

UNITED STATES PATENT AND TRADEMARK OFFICE

CERTIFICATE OF CORRECTION

PATENT NO. : 5,876,616

DATED : Mar. 2, 1999

INVENTOR(S) : Thomas Aurrekoetxea Ugalde, et al

It is certified that error appears in the above-identified patent and that said Letters Patent is hereby corrected as shown below:

Column 1, line 6: change "metal" (2nd Occurrence) to --melt--

Column 1, line 12: change "metal" to --melt--.

Signed and Sealed this

Seventh Day of September, 1999

*Attest:*

Q. TODD DICKINSON

*Attesting Officer*

*Acting Commissioner of Patents and Trademarks*